United States Patent [19]

Zimmermann

[11] Patent Number: 4,512,511

[45] Date of Patent: Apr. 23, 1985

[54] DIVIDED DISPLAY CONTAINER

[75] Inventor: John Zimmermann, Scarborough, Canada

[73] Assignee: Somerville Belkin Industries Limited, London, Canada

[21] Appl. No.: 566,338

[22] Filed: Dec. 28, 1983

Related U.S. Application Data

[63] Continuation of Ser. No. 370,105, Mar. 20, 1982.

[51] Int. Cl.[3] ..... B65D 5/48

[52] U.S. Cl. ..... 229/15; 206/44 R; 229/27; 229/52 A

[58] Field of Search ..... 229/15, 27, 52 A, 52 AL, 229/52 AC; 220/409, 8; 206/427, 526, 804, 561, 44 R, 45.14

[56] References Cited

U.S. PATENT DOCUMENTS

| | | | |
|---|---|---|---|
| 973,429 | 10/1910 | Hilliker | 229/28 R |
| 1,004,791 | 10/1911 | Johnson | 229/28 R |
| 1,975,127 | 10/1934 | Sherman | 229/15 |
| 2,021,208 | 11/1935 | Stouffer | 229/15 X |
| 2,593,092 | 4/1952 | Bergstein | 229/15 X |
| 2,603,409 | 7/1952 | Crary | 229/52 A X |
| 2,643,810 | 6/1953 | Fleming | 229/15 |
| 2,844,294 | 7/1958 | Williams | 229/15 X |
| 3,187,889 | 6/1965 | Sinclair | 206/561 X |
| 3,393,828 | 7/1968 | Atkinson | 229/52 A X |
| 3,758,018 | 9/1973 | Black | 229/15 |
| 3,861,579 | 1/1975 | Manis et al. | 229/28 R X |
| 4,130,235 | 12/1978 | Killy | 229/15 |
| 4,272,008 | 6/1981 | Wozniacki | 229/15 |

FOREIGN PATENT DOCUMENTS

| | | | |
|---|---|---|---|
| 1486597 | 6/1969 | Fed. Rep. of Germany | 229/15 |
| 466581 | 5/1937 | United Kingdom | 229/15 |
| 725809 | 3/1955 | United Kingdom | 229/15 |
| 1285039 | 8/1972 | United Kingdom | 229/44 R |

*Primary Examiner*—William Price
*Assistant Examiner*—Gary E. Elkins
*Attorney, Agent, or Firm*—Fetherstonhaugh & Co.

[57] ABSTRACT

The invention is a paperboard container having a base, a cover, and a divider in the base, the divider having four panels that each radiate from a common center and terminate in a corner of the base. The dividers extend above the height of the base to form a guide for the cover as it is telescoped thereover and form a rigid container structure strengthened by the dividers.

2 Claims, 6 Drawing Figures

DIVIDED DISPLAY CONTAINER

This invention relates to a divided container and is a continuation of application Ser. No. 06/370,105 filed on Mar. 20, 1982.

The container art is a very well developed art. Prior to this invention there is a vast number of constructions for divided containers each of which probably has advantages over most of its competitors as least for a specific purpose. While the container art is a crowded one, it is also one that is continually improving and expanding. Packaging is one of the most active industries in our society and improvements in packaging are developed on almost a daily basis.

Even with the multitude of containers with dividers that are already in place in the prior art, there are requirements that cannot be fullfilled by the prior art as well as one would like them to be fullfilled.

This particular invention provides a new inexpensive, good looking rigid container for products that require a container of good appearance and high rigidity. One can always obtain a good looking container with the necessary rigidity at a price. Good appearance and rigidity can always be obtained if one is willing to pay any price. It is not too often that one can obtain these qualities at a lesser cost than is customary in the trade.

This invention achieves a good looking container that is structurally rigid at a highly competitive price. It has further the ability to display the product that it packages in an attractive manner for consumption.

The container may well have many uses, but it has been successfully used for packaging chocolate mint stick confectionery and this embodiment will be described. Confectionery containers are usually designed to display the contents immediately the cover is removed. This container achieves this objective in a most attractive manner because it maintains the contents in an upright position through the function of the dividers.

The objects of the invention have been achieved with the combination of a specific design of divider, base and cover that cooperate to achieve the good appearance and rigidity at a competitive price.

A paperboard container and divider according to the present invention comprises a base having a bottom and four side walls each at right angles to the bottom; a divider having four divider panels each radiating from a common central axis and each having a free end that terminates in a corner formed by two of said side walls of said base; a cover for said having base having a top and four side walls each at right angles to the top, the cross section of said cover being the same as the cross section of said base; said divider panels extending to a height above the side walls of said base a distance equal to the height of the side walls of said cover whereby the free ends thereof form a cover guide as the cover is telescoped thereover to cause the side walls of the cover to abutt the side walls of the base. The invention will be clearly understood after reference to the following detailed specification read in conjuction with the drawings.

Figure 1:
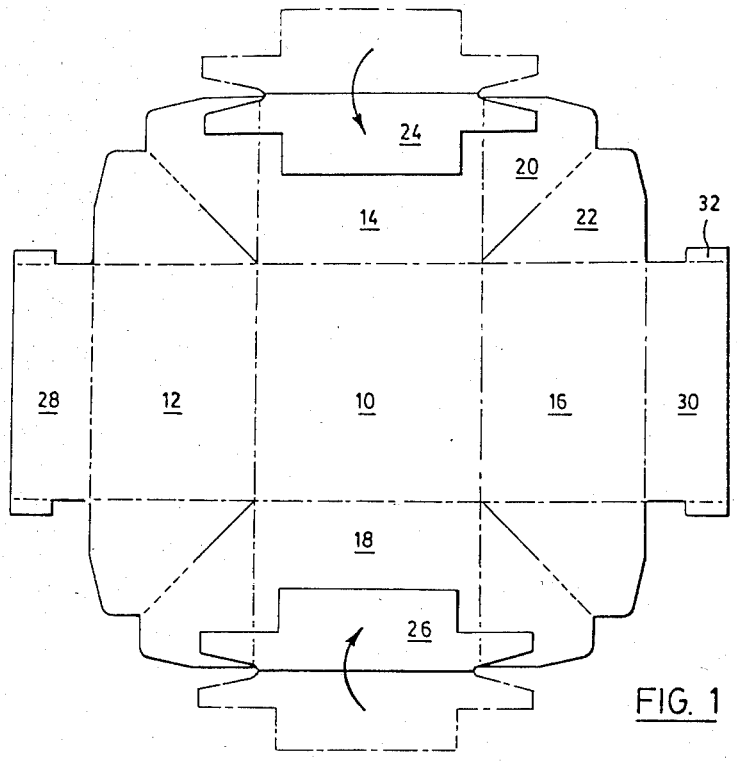
FIG. 1 is a blank from which the base portion of a container for use with the divider herein described is made.

The blank has a bottom panel 10 and side panels 12, 14, 16 and 18. The side panels are each interconnected by similar triangular corner panels 20 and 22. Catch panels 24 and 26 are hinged to the outer edges of side panels 14 and 18 respectively and latch panels 28 and 30 are hinged to the edges of end panels 12 and 16 respectively.

The first step in forming the blank of FIG. 1 into a container 11 is to fold over the catch panels 24 and 26 from the broken line position and adhesively secure them in the solid line position as indicated in FIG. 1. The next step is to fold up the side walls by exerting pressure. It will be apparent that as the side walls are folded to an upright position they are articulated with respect to each other by reason of the operation of the folding corner panels 20 and 22. This is a known expedient for setting up a container and is not referred to in detail.

Figure 2:
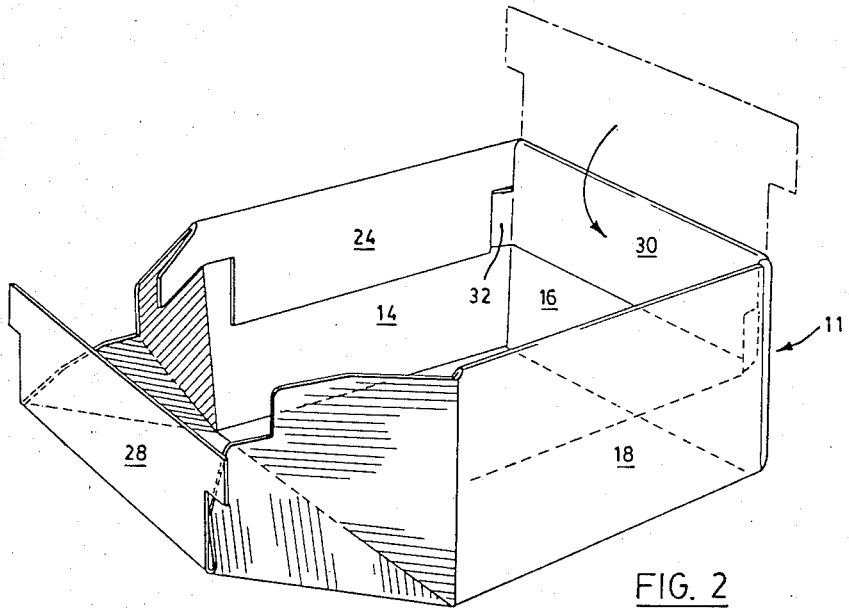
FIG. 2 is an illustration showing the manner in which the blank of FIG. 1 is set up.

FIG. 2 illustrates three walls in a vertical position. To complete the assembly of these walls the latch flap 30 is folded from the dotted line position to the solid line position. As it does so the outlying tabs on the latch flap 30 fall behind and lockedly engage in the cutout on the catch flap 24 as at 32.

Figure 6:
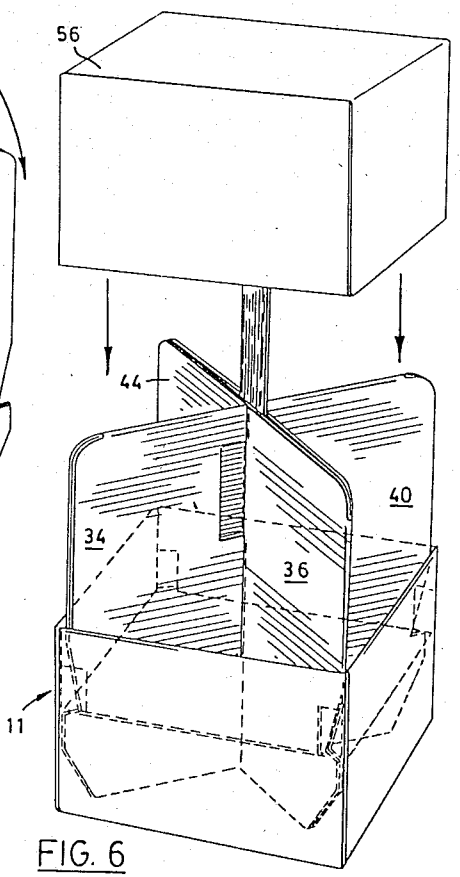
FIG. 6 is an illustration of the divider in a container with a cover therefor; and Referring to the drawings and at first to FIGS. 1 and 2 which illustrate a blank for forming the container generally indicated by the numeral 11 in FIG. 6.

The fourth wall 12 is illustrated in the process of being set up. It is completed in a similar manner to the wall 16 to form a set up container 11 as illustrated in FIG. 6. This particular method of setting up a container is not broadly new and further reference to it is not made in this specification.

Figure 3:
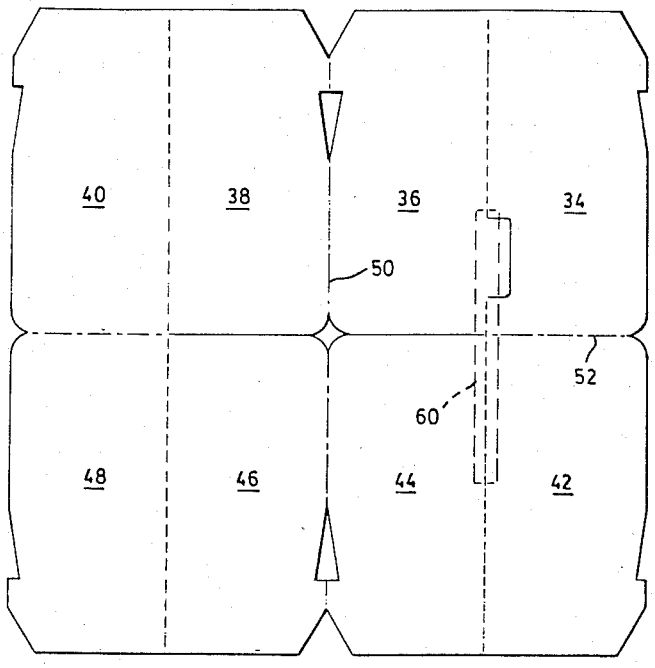
FIG. 3 is an illustration of a blank from which the divider of is constructed.

The blank from which the divider is made is illustrated in FIG. 3 and comprises a series of panels 34, 36, 38 and 40 and a series of similar panels 42, 44, 46 and 48. Panels in each series are serially arranged and each hinged to their next following panel at connecting side edges illustrated by the broken lines. These lines are cut where indicated by a solid line and the blank folds easily about them.

Figure 4:
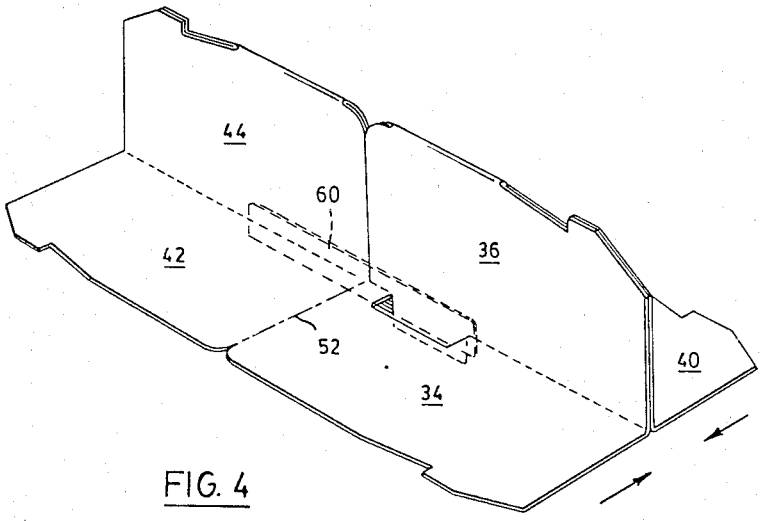
FIGS. 4 and 5 are illustrations showing the manner in which the blank of FIG. 3 is folded to form a divider.

In set up, the blank is folded about the line 50 so that panels 36 and 38 are in juxtaposed relation and panels 44 and 46 are in juxtaposed relation as illustrated in FIG. 4.

The next step in forming the divider is to fold the structure of FIG. 4 about the ends of the panels and the fold line 52. In this respect it will be noted that the ends of panels 46 and 38 and panels 44 and 36 are separated by a full cut line. The folding action is about the broken cut hinge line between panels 40 and 48 and panels 34 and 42.

Figure 5:
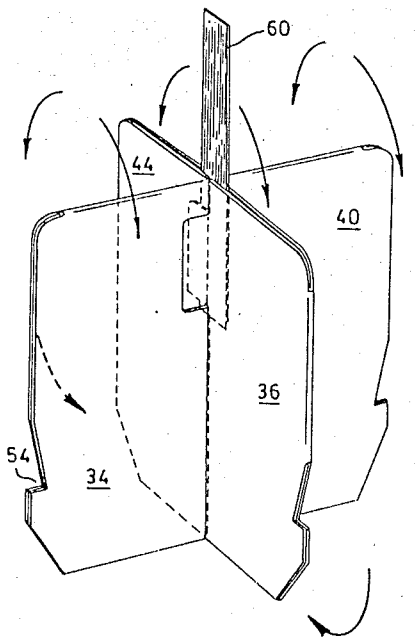

This fold completed, the divider assumes the form of FIG. 5. The result is a divider having four radially extending two-ply divider panels all made out of one piece of cardboard that is of very good appearance. The sides of the end panels of the blank are notched to form catches 54 in the edges of the finished divider panels which are designed to lock against the lower edges of the flaps 24, 26, 28 and 30 of the container which comprise locking means for the catches 54 as the divider is projected into the container as illustrated in FIG. 6.

Once in position they lock in position against removal under normal conditions of use.

In FIG. 6 it will be noted that the divider walls extend above the bottom of the container 11 a distance equal to the height of the sidewalls of the cover so that when the cover is telescoped over the bottom the edges of the sidewalls of the cover will abutt the edges of the sidewalls of the cover and the upper edges of the divider will underlie the top wall of the cover. This extension, in addition to giving rigidity and a means for guiding the cover over the bottom, permits the display of, say, peppermint sticks packaged in the container and also permits the easy removal of the peppermint sticks. It will be apparent that the divider effectively divides the cross-sectional area of the container 11 into four triangular shaped areas each of which is capable of containing and separating a plurality of vertical stick-like items and maintaining them in a vertical position as items are removed. In an actual container the base of the bottom portion 11 had a dimension of about three inches.

The upstanding side edges of the divider that project above the upper edge of the container give rigidity to the cover 56 which is telescoped onto the base. The edges of the cover side walls and the base side walls meet and are held rigidly in position by the divider end walls. This is of importance where the container as a whole is wrapped with a transparent film after packing for sale in a retail store.

In many instances in use the container is set on a dinner table and it is desired to move it or pass it from place to place. The ribbon 60 is useful for this purpose. It can very conveniently and economically be incorporated into the construction. The ribbon 60 is laid under the boundary line between panels 34, 36 of one series and 42, 44 of the other series and is adhesively secured adjacent one of its ends to a tab which is cut from panel 34 so as to be continuous with panel 36 as shown in FIGS. 3 and 4. This tab formation gives a good glue area for securement of the ribbon to the divider. When the divider is set up as described above the ribbon automatically assumes the position of FIG. 5.

A package for a good quality confection, for example, must have a lid or cover that conveniently telescopes over the base. This has commonly been provided in the past with a base having rigid upstanding walls over which the cover telescopes. The walls in a good quality container of this type must be a more rigid and permanent construction than the knock-down base 11 of the container described herein. It would not be acceptable for a high quality container to telescope the cover over the side walls of a base formed from knock down container as the bottom 11 of the present container is formed. With this invention the requirement for a rigid upstanding wall to receive the cover is achieved with the divider the ends of which are rigidly located by the base of the container to project upwardly to telescopingly receive the cover. The divider and the base have been combined to form a rigid construction the basis of which is triangular configurations. As the cover is telescoped over the dividers it also is rigidified by reason of the cooperation of the ends of the dividers and the walls of the cover. The arrangement is very positive and very rigid. The cover and base of the container are rigidified by interlock with the divider panels.

A container according to the present invention has rigidity in all directions and can be overwrapped with a heat sealable plastic translucent overwrap on automatic machinery. Rigidity of the container being wrapped is an essential characteristic for a satisfactory overwrap construction. This container has proven itself satisfactory in this respect notwithstanding its knock-down and inexpensive construction.

Embodiments of the invention other than the one illustrated will be apparent to those skilled in the art and it is not intended that the invention should be restricted by the foregoing disclosure.

What I claim as my invention is:

1. A paperboard container and divider comprising:

a container base having a bottom and four side walls which intersect in upstanding corners each disposed at right angles to the bottom;

a divider having four divider panels each radiating from a common central axis extending normal to the center of said bottom and each panel having a free side edge that extends upright parallel to said axis within a corner formed by two of said side walls of said base and extends beyond said base;

a cover for said base operative to close the container and having a top which in closed position lies parallel to said bottom, and the cover having four side walls each at right angles to the top, the cross section of said cover taken normal to said axis being the same as the cross section of said base, and the corners formed by the four side walls of both the base and the cover being everywhere mutually parallel and parallel with said axis;

locking means located internally of the base and cooperating with catch means on the free side edges of the divider to maintain the divider fixed within the base; and each of said upright free side edges of said divider panels extending in a straight line above the side walls of said base to a height equal to the height of the side walls of said cover, whereby the free side edges of the divider fit into the corners of the cover and form a cover guide as the cover is slidingly telescoped over the divider to said closed position wherein the free lower edges of the side walls of the cover abutt the free upper edges of the side walls of the base.

2. A paperboard container and divider as claimed in claim 1 wherein said divider is made from a single blank, said blank having two similar interconnected series of four similar panels, the panels having side edges and end edges, the panels of each series being serially arranged and each hinged to its next following panel in series at connecting side edges, the first panel of each series being hinged at connecting end edges to the first panel of the other series, and the fourth panel of each series being hinged at connecting end edges to the fourth panel of the other series; the blank being foldable along the line interconnecting the second and third panels of said two series of panels to cause the second and third panels of each series of panels to lie in juxtaposed relation; the blank being foldable along the line between the ends of the first panels and ends of the fourth panels of each series to cause the first panel and the fourth panel of each series to lie in juxtaposed relation to the first and fourth panels respectively of the other series whereby the blank is formed into said divider of four double ply divider panels radiating from said central axis; the interior side walls of the base having said locking means, the ends of the double ply divider panels having said catch means adapted to engage with said locking means as the divider is inserted into the base to secure the divider into the base; a lifting ribbon secured to said blank to overlie the marginal edges of a line that defines the hinged connections between the first and second panels of each of said series of panels, said ribbon being secured as aforesaid to only one of said four first and second panels, said ribbon being adapted to extend above the free ends of second and third panels of each series in the set up divider whereby to provide a lifting ribbon for the set up divider.

* * * * *